United States Patent [19]

Hashimoto et al.

[11] Patent Number: 4,634,179

[45] Date of Patent: Jan. 6, 1987

[54] AIR LUMBAR SUPPORT DEVICE

[75] Inventors: Nobuyuki Hashimoto, Toyota; Shigeru Nishio, Kariya, both of Japan

[73] Assignee: Aisin Seiki Kabushiki Kaisha, Kariya, Japan

[21] Appl. No.: 814,174

[22] Filed: Dec. 24, 1985

Related U.S. Application Data

[63] Continuation-in-part of Ser. No. 517,689, Jul. 27, 1983.

[30] Foreign Application Priority Data

Jul. 31, 1982 [JP] Japan ..... 57-133871

[51] Int. Cl.[4] ..... A47C 3/00

[52] U.S. Cl. ..... 297/284; 297/DIG. 3

[58] Field of Search ..... 297/284, DIG. 3, 460

[56] References Cited

U.S. PATENT DOCUMENTS

| | | | |
|---|---|---|---|
| 3,983,640 | 10/1976 | Cardullo et al. | 297/DIG. 3 |
| 4,059,909 | 11/1977 | Kron | 297/DIG. 3 |
| 4,078,842 | 3/1978 | Zur | 297/284 |
| 4,175,297 | 11/1979 | Robbins et al. | 297/DIG. 3 |

FOREIGN PATENT DOCUMENTS

| | | | |
|---|---|---|---|
| 2926552 | 1/1981 | Fed. Rep. of Germany | 297/284 |
| 3207068 | 9/1983 | Fed. Rep. of Germany | 297/DIG. 3 |

*Primary Examiner*—Francis K. Zugel

*Attorney, Agent, or Firm*—Oblon, Fisher, Spivak, McClelland, & Maier

[57] ABSTRACT

An air lumbar support device utilized in an automobile seat for adjusting the curvature of a seat back by selectively regulating air pressures of a plurality of air bags accommodated in the seat back. The support device includes a pressure sensor detecting the air pressures of the seat bags, an input circuit supplying an electric signal from the pressure sensor to a control circuit, an output circuit receiving electric signal from the control circuit and causing an air control valve to actuate to thereby control the air pressures of the air bags, and a memory circuit memorizing and reading the electric signal supplied from the input circuit to the control circuit.

1 Claim, 4 Drawing Figures

AIR LUMBAR SUPPORT DEVICE

This application is a continuation-in-part of application Ser. No. 517,689, filed July 27, 1983.

BACKGROUND OF THE INVENTION

1. Field of the Invention

This invention relates to air lumbar support devices in general, and more particularly to an air lumbar support device of the type utilized in an automobile seat.

2. Prior Art of the Invention

It is well known in the art to provide the seat back of an automobile seat with a plurality of horizontally disposed parallel air bags so that the curvature of the seat back can be adjusted selectively by regulating the air pressure within the individual air bag. Referring to FIG. 1 showing a conventional air lumbar support device, each air bag 11 of a seat back 10 is uniformly provided with pressurized air supplied from an electric-powered air pump 12. The air pressure of each air bag 11 is controlled by an air control valve 13 so that the lumbar portion of the driver may fit the seat back 10 in the most suitable state. More particularly, through means of the air control valve 13 the pressurized air is supplied from the air pump 12 to each air bag 11 to thereby cause the air bag to inflate.

The internal air pressure of each air bag 11 can be held by the check valve (not shown) accommodated in the air control valve 13. Under these conditions, the check valve is brought in its opened portion when the switch knob (not shown) of each air bag 11 is pushed, and during pushing the switch knob the check valve can be maintained in its opened position. Subsequently, the pressurized air will be released from each air bag 11 respectively so that the curvature of the seat bag 10 may be adjusted into the suitable form.

In the above-mentioned conventional air lumbar support device, however, each time the driver is relieved, it will be necessary to re-adjust the air pressures of the seat bags into the suitable state for the driver or into the state which the driver desires. Since the air pressures should be adjusted manually, the performance of the operation is inferior and then it takes much time to complete the adjustment of the air pressures. Moreover, the manual adjustment must be usually completed during stopping the automobile, namely the manual adjustment can not be easily completed during driving the automobile.

SUMMARY OF THE INVENTION

One general object of the present invention, therefore, is to provide a new and improved air lumbar support device which eliminotes the foregoing disadvantages of prior art lumbar support devices.

More specifically, it is an object of the present invention to provide a new and improved lumbar support device wherein the air pressure in the individual air bag can be automatically adjusted into the most suitable state for each driver with an easy operation of a selective switch.

Another object of the present invention is to provide a new and improved air lumbar support device which is comparatively simple in construction and thoroughly reliable in operation, and economical to manufacture.

In one illustrative embodiment of the present invention, there is provided an air lumbar support device which includes a plurality of parallel air bags horizontally disposed and accommodated in an automobile seat back, an electric-powered air pump supplyong the pressurized air to each air bag, a solenoid activated air control valve controlling the air pressure in the individual air bag, a pressure sensor detecting the air pressure in the individual air bag, an input circuit supplying an electric signal from the pressure sensor to a control circuit, an output circuit receiving an electric signal from the control circuit and causing the air control valve to actuate, and a memory circuit memorizing and reading the electric signal which is supplied from the pressure sensor and indicates the air pressure value in the individual air bag. The air lumbar support device further includes an operation panel provided with a mode change over switch, a pressure value memory select switch, and a manual switch causing the air control valve to actuate. Furthermore, the above control circuit operates to receive and supply the electric signals for the synchronization and sequence controls between the above electric circuits.

In accordance with one feature of the present invention, for each driver the optimum air bag pressure can be called from the memory circuit and be automatically established by the easy operations of the control switches on the operation panel. Even in case of the same driver, the air bag pressure can be established into the desirable one of the several air bag pressures, which are memorized beforehand, with the easy switch operations.

In accordance with another feature of the present invention, since the system is controlled by electric signals, it may be possible to attain the massage effect of the back and lumbar portions for recovering the fatique of the driver by means of automatically oscillating the air bag pressures in several kinds of patterns.

In accordance with a further feature of the present invention, since there is provided the memory circuit, the air bag pressure is not previously designated by a manufacture of air lumbar support devices, but the air bag pressure can be freely selected and memorized by the driver.

The above noted as well as further objects and features of the present invention will be understood more clearly and fully from the following detailed description of a preferred embodiment thereof, when read with reference to the accompanying drawings.

DETAILED DESCRIPTION OF THE PREFERRED EMBODIMENT OF THE INVENTION

Figure 1:
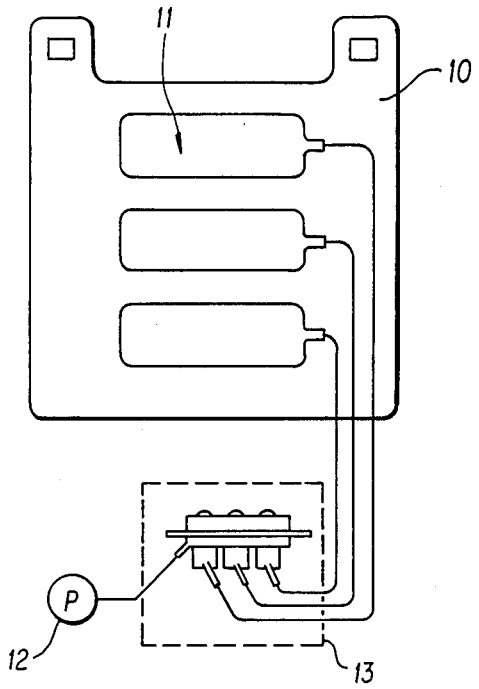
FIG. 1 is a schematic diagram showing an operational system of a conventional air lumbar support device.
Figure 2:
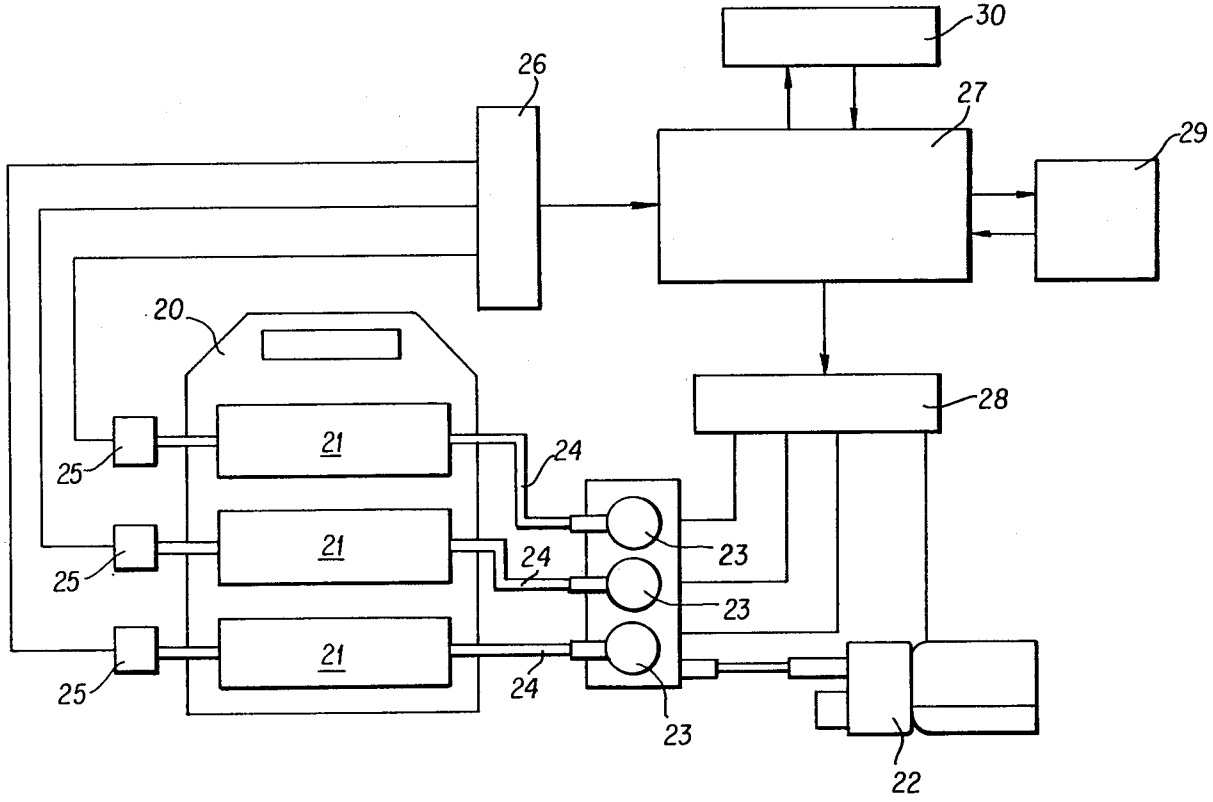
FIG. 2 is a schematic diagram showing an operational system of an air lumbar support device according to the present invention.

Referring now to FIG. 2 showing an operational system of an air lumbar support device, three parallel air bags 21 are horizontally disposed and accommodated in an automobile seat back 20. The bags are placed in the seat back in a manner known in the prior art and shown in FIG. 1. It may be arranged in any manner to provide comfortable pressure against the drivers back. The pressurized air is supplied to an interior of each air bag 21 by an electric-powered air pump 22. The air pressure in the individual air bag 21 is adjusted by the operations of three solenoid activated air control valves 23 positioned between the air bags 21 and the air pump 22. The air pump and the solenoid activated air control valves may be placed in any convenient location, but are preferably disposed within the automobile seat in order to be close to the air bags. Each air control valve 23 comprises a check valve (not shown) allowing the air flow from the air pump 22 to each air bag 21 and a relief valve (not shown) releasing the pressurized air from the air bag 21, and is connected with each corresponding air bag 21 by means of each corresponding air line 24. The check valve keeps pressurized air within the air bag when in the closed position and allows air to flow from the air pump to the air bag when in the open position due to the differential pressure between the air bag and the air line 24. The relief valve allows pressurized air from the air bag to escape to the atmosphere when the valve is moved to the open position by the action of the solenoid moving a push rod against the check valve. Each pressure sensor 25 detects the air pressure of each corresponding air bag 21 and supplies the electric signals corresponding to the detected air pressure through an input circuit 26 to a control circuit 27. Each pressure sensor is in fluid communication with the air pressure of its corresponding air bag and accordingly must be mounted nearby, preferably within the seat back. Pressure sensors which accomplish this goal are well known and may be, for example, a semiconductor-type pressure sensor having a balanced bridge including a strain gauge mounted on a diaphragm which detects the pressure by way of a change of electrical resistance due to the deformation of the diaphragm. An output circuit 28 receives the electric signals supplied from the control circuit 27 and causes the air control valves 23 to actuate. A memory circuit 29 can memorize and read the electric signals supplied from the pressure sensors 25 to the control circuit 27, namely the electric siganslindicating the air pressure valves in the air bags 21. The above control circuit 27 operates to receive and supply the electric signals for the synchronization and sequence controls between the above individual circuits. Sequence controls include the signals among the input circuit, output circuit and memory circuit which automatically adjust the air pressure in each air bag to the memorized pressure value. The synchronization controls means the simultaneous adjusting of the air pressure in each air bag to the memorized pressure value by synchronizing the operation of the air control valve with the air pump.

Figure 3:
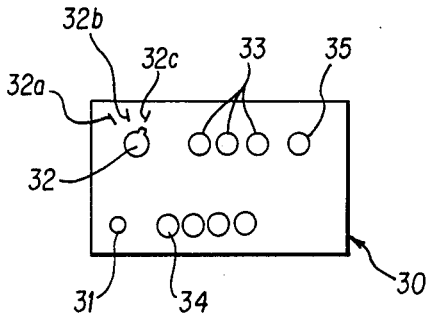
FIG. 3 is an enlarged diagram of an operation panel in FIG. 2.

An operation panel 30 shown in FIG. 3 is provided with an electric power source switch 31 and a mode change over switch 32 which changes over a manual mode 32*a*, an bag pressure memory mode 32*b*, and an air bag pressure call operation mode 32*C*. A manual switch 33 has three switch elements for the air control valves 23 to thereby allow the independent operation of each control valve 23 and to thereby adjust the air pressure in the individual air bag 21. A memory select switch 34 having a plurality of switch elements is provided so as to memory the air pressures of the air bags 21 and at the same time so as to select the memorized air pressures. Further, there is provided a manual switch 35 for causing the electric-powered air pump 22 to operate.

The operation panel may be mounted in any convenient location so that it is easily operable while the operator is driving. For example it could be mounted on the dashboard, steering column or door panel. The mounting may be accomplished by any of several conventional methods. Likewise, the electrical circuits may be physically included in the same box as the operation panel or may be separately mounted within the seat in a position near the sensors and control valves.

Thus, the operation panel supplies the instructions from the driver as to how the air bag should be adjusted. The control circuit receives the instructions from the operation panel and properly performs one of three actions depending on the instructions from the operation panel. Thus, the control circuit either receives the input signal and stores it in memory, receives the input memory and compares it to a stored signal from the memory to produce an output to control the air valves, or passes the manual controls from the operation panel through to the air valves. Thus, this control circuit acts as a data switching device and in the one mode includes a comparison. The memory circuit memorizes data from the control circuit and recalls it under the command of the control circuit. The input circuit converts the analog signal from the pressure sensors to a digital sensor which may be utilized by the control circuit. Likewise, the output circuit changes the digital signal from the control circuit to an analog signal for controlling the solenoid valves and air pump. The individual components of the input, output, memory and control circuits are well known in the digital control area and may be any of several commercially available devices.

In operation of the above-mentioned air lumbar support device after the electric power source switch 31 is turned on, when the mode change over switch 32*a* is set at the manual mode 32, the air pressure of air bag 21 can be independently adjusted into the air pressure, the driver desires, by means of the manual operations of the manual switches 33 and 35 for the air control valves 23 and the air pump 22. Thus, each air bag can be individually set manually by using the particular switch 33 corresponding to that bag and also pushing the manual air pump button 35. Likewise, if the air pressure in any of the bags is higher than desired, air may be released from the bag to the atmosphere by way of the relief valve in the air control valve for that bag. This is accomplished by actuating the manual switch 33 corresponding to that bag without actuating the manual pump button. By using this procedure, the air pressure in each bag can be set so that the driver is comfortable. When the mode change over switch 32 is set at the pressure memory mode 32*b*, such determined air pressures of the air bags 21 are read by the pressure sensors 25 and memorized corresponding to each switch element of the memory select switch 34. This is accomplished by transmitting the signals from each pressure sensor via the input circuit to the control circuit which causes the signal to be read into memory at the address selected by the memory select switch 34 of the operation panel. It may be possible to increase the number of the memorized set pressure valves by means of increasing the switch elements of the memory select switch 34. Next, when the mode change over switch 32 is set at the pressure call operation mode 32*c*, the memorized pressures is read by selecting one switch element of the memory select switch 34, thereby automatically controlling the air bag pressure into the set pressure valve. This is accomplished by having the control circuit compare the air pressure detected by the pressure sensor with the memorized pressure read out of memory circuit 29. This comparison determines whether the air bag has too much or too little pressure and is used to control the air control valve and the air pump to either increase or decrease the pressure for each bag. When the air pressure detected by the pressure sensor 25 equals the memorized pressure read out of memory circuit 29, the operation of the air control valves 23 and the air pump 22 is stopped. The air bag pressure is maintained at the memorized pressure which is read out of the memory circuit. Therefore, it may be possible to establish and adjust automatically the optimum air bag pressure for each driver by the easy operations of the switches.

Thus, by using the above-described apparatus each driver can set the pressures of the air bags to values which make his back feel comfortable. Once this is done, that pressure may be reestablished, even while driving merely by pushing the buttons on the operation panel. The driver may even have several settings which he may change by using the same buttons so as to avoid fatigue by sitting in one position at all times. When drivers are changed, it is easy to adjust the pressure in the bags for each new driver by merely pressing the same buttons on the operation panel so as to recall from memory the pressures required for that driver.

Figure 4:
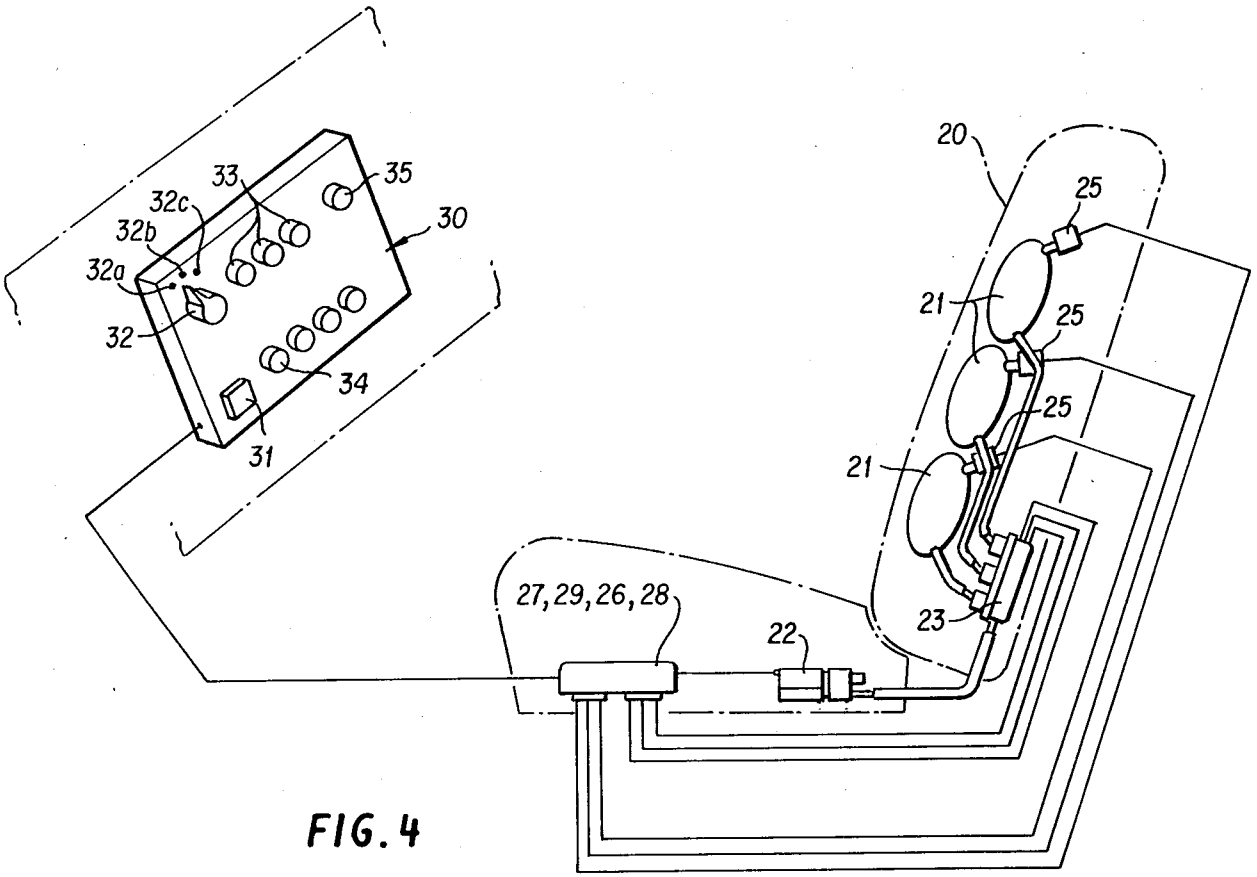
FIG. 4 is a schematic diagram showing the location of the air lumbar support device in an automobile seat.

FIG. 4 shows the configuration of the air bags 21 in the seat back 20 of an automobile. It also shows the arrangement of the air pump and valves in the seat as well as the various control circuits. The operation panel 30 is also shown as being mounted on a dashboard within the reach of the operator who sits in this seat. The various controls on the operation panel are shown in a manner similar to FIG. 3.

Obviously those skilled in the art may make various changes in the details and arrangements of parts without departing from the spirit and scope of the invention as defined by the claims hereto appended, and it is therefore desired that the invention be not restricted to the precise construction herein disclosed.

What is claimed is:

1. An air lumbar support device in an automobile seat for adjusting the curvature of a seat back comprising:

a plurality of air bags accommodated in said seat back;

an electric-powered air pump supplying pressurized air to said air bags;

a solenoid activated air control valve connected to said air bags and controlling the air pressures of said air bags;

a pressure sensor detecting the air pressures of said air bags and supplying an electric signal indicative of said pressure;

an input circuit receiving said electric signals from said pressure sensor and supplying an output electric signal;

an output circuit for receiving an input electric signal and producing an output which causes said air control valve and said air pump to actuate;

a control circuit for receiving said output electric signal from said input circuit and supplying said input electric signal to said output circuit;

a memory circuit connected to said control signal for storing said output electric signals supplied from said input circuit to said control circuit;

a manually controlled operation panel provided with a mode changeover switch, a pressure valve memory select switch, and a manual air pump switch in connection to said control circuit;

wherein said control circuit is directed by said operation panel to store in said memory said electric signal from said input circuit when said mode changeover switch is in a first position; to read from said memory a stored signal and compare said stored signal to said electric signal from said input circuit to supply said input electric signal to said output circuit when said mode changeover switch is in a second position; and to permit manual control of said input electric signal to said output circuit when said mode change over switch is in a third position;

wherein the pressure in said air bags may be manually adjusted for the occupant's comfort, said pressures stored in memory, and used to control said air bags to retain said pressures when called out of memory by the occupant.

* * * * *